US005780961A

United States Patent [19]

Power

[11] Patent Number: 5,780,961

[45] Date of Patent: Jul. 14, 1998

[54] GROUND PLANE INSULATING COATING FOR PROXIMITY FOCUSED DEVICES

[75] Inventor: Gary D. Power, Manteca, Calif.

[73] Assignee: Regents of the University of California, Oakland, Calif.

[21] Appl. No.: 26,797

[22] Filed: Mar. 5, 1993

[51] Int. Cl.[6] ..... H01J 43/04

[52] U.S. Cl. ..... 313/376

[58] Field of Search ..... 313/376, 377, 313/379, 387, 528, 534; 250/214 VT

[56] References Cited

U.S. PATENT DOCUMENTS

| | | | |
|---|---|---|---|
| 3,609,433 | 9/1971 | Freedman | 313/65 R |
| 3,760,216 | 9/1973 | Lasser et al. | 313/528 X |
| 4,310,857 | 1/1982 | Lieber et al. | 358/217 |
| 4,350,919 | 9/1982 | Johnson et al. | 313/99 |
| 4,481,531 | 11/1984 | Warde et al. | 313/528 |
| 4,725,723 | 2/1988 | Shimojima | 250/205 |
| 4,902,930 | 2/1990 | Van Der Mast | 315/12.1 |
| 4,996,414 | 2/1991 | Frank et al. | 250/213 |
| 5,268,612 | 12/1993 | Aebi et al. | 313/528 X |

*Primary Examiner*—Sandra L. O'Shea
*Attorney, Agent, or Firm*—Henry P. Sartorio; L. E. Carnahan

[57] ABSTRACT

A thin layer of alumina (aluminum oxide) is coated onto the ground plane of a microchannel plate (MCP) without covering the pores of the MCP so it does not effect the performance. The coating is sputtered onto the ground plane at a very steep angle. The addition of the thin dielectric coating of alumina greatly improves the spatial resolution of proximity focused image intensifiers using a narrow gap between the phosphor screen and the MCP. With the coating on the ground plane and the same gap the phosphor screen can be ran at 9000 volts, as compared to 3 kV without the coating.

20 Claims, 1 Drawing Sheet

GROUND PLANE INSULATING COATING FOR PROXIMITY FOCUSED DEVICES

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to proximity focused devices, particularly to improving the resolution of image intensifying devices by increasing the dielectric strength between the photocathode microchannel plate (MCP) and the phosphor screen, and more particularly to forming a coating on the MCP without covering the holes therein and to a process for forming the coating.

Proximity focused devices of various types are known in the art, as exemplified by U.S. Pat. No. 3,609,433 issued September 1971 to M. D. Freedman; U.S. Pat. No. 4,310,857 issued Jan. 12, 1982 to A. J. Lieber et al.; and U.S. Pat. No. 4,996,414 issued Feb. 26, 1991 to R. Frank et al. Substantial effort has been directed to various approaches for improving the resolution of proximity focused devices, particularly those involving the use of image intensifiers. One of these prior approaches involves the use of microchannel plates wherein the ground plane thereof is located in closely spaced relation to the phosphor screen having a positive potential applied thereto. If a high voltage is applied to improve to resolution of the image intensifying device, there is a breakdown, thereby requiring such devices to operate a lower than desired voltages.

It is thus seen that there has been a need in the art of proximity focused image intensifiers to find a way to improve the spatial resolution without creating a breakdown. It has been recognized that in image intensifiers where a MCP is in close proximity to a phosphor screen, a close gap and a high field results in a smaller spread from each channel of the MCP and therefor better spatial resolution. The present invention provides a means and process for accomplishing both the desired close gap and high field, by providing a thin coating of dielectric material on the ground plane of the MCP without interfering with the performance of the MCP.

SUMMARY OF THE INVENTION

It is an object of the present invention to provide a means for providing improved spatial resolution of proximity focused image intensifiers.

A further object of the invention is to provide a process for coating the ground plane of a microchannel plate without adverse effect on the performance of the plate.

A further object of the invention is to provide a process for coating a dielectric on the ground plane of a microchannel plate used in combination with a phosphor screen for improving the spatial resolution of an image intensifying device.

Another object of the invention is to improve the resolution of an image intensifying device using a microchannel plate and a phosphor screen by applying a thin layer of aluminum oxide, for example, to the ground plane of the plate without covering the holes therein.

Another object of the invention is to provide a process for coating the ground plane of a microchannel plate with a dielectric without covering the holes of the plate.

Other objects and advantages will become apparent from the following description and accompanying drawings. Basically, the invention involves providing the ground plane of a microchannel plate with a thin (3 microns) layer of a dielectric, such as by coating a layer of alumina (aluminum oxide) $Al_2O_3$, without covering the holes in the plate for improving the spatial resolution when the plate is positioned in close (0.020 inch) proximity to a phosphor screen of a proximity focused image intensifier. The thin coating is applied at a steep angle (75° for example) so as not to cover the holes in the plate that emits electrons which form the image on the phosphor screen. By use of this thin coating, voltages of up to 9000 volts have been used without a breakdown, thus greatly improving the spatial resolution.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

Figure 3:
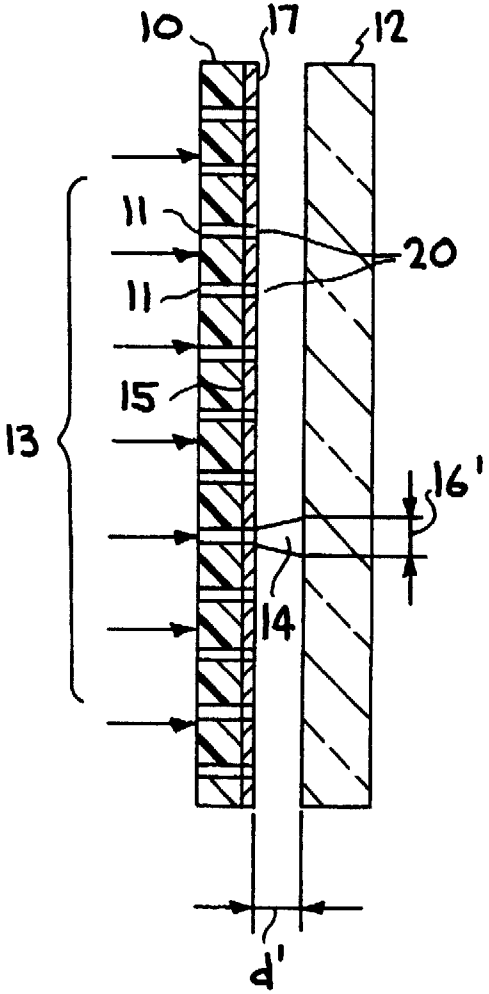
FIG. 3 is a cross-sectional view of the coated MCP and an associated phosphor screen positioned in a closer spaced relation to the MCP than in the prior art device of FIG. 1.

The invention is directed to a means for improving the spatial resolution of proximity focused image intensifiers using a microchannel plate (MCP) and a phosphor screen, such as used in night vision goggles, streak cameras, etc. The invention incorporates a process for forming a thin layer of dielectric material on the ground plane of the MCP without adverse effect on the performance of the MCP. The process involves a form of shadow masking wherein the dielectric, such as alumina (aluminum oxide) $Al_2O_3$ is deposited, such as by sputtering, to a thickness of 3 microns, for example, at a steep angle, such as 75 degrees from normal, onto the ground plane of the MCP without covering the holes in the MCP.

The limit to the spatial resolution in proximity focused image intensifiers is normally the gap spacing from the back or ground plane of the microchannel plate to the phosphor screen. A close gap and a high field results in a smaller spread from each channel of the MCP, thus producing a small spot size and therefore better spatial resolution. The present invention allows the MCP to phosphor screen gap to be closed up and run at higher voltages.

After the normal electroding of the ground plane of an MCP, a 3 micron coating of a dielectric or insulator material, such as $Al_2O_3$, is sputtered at a very steep angle, such as 75°, onto the back or ground plane. Due to this very steep angle of sputtering, for example, the dielectric does not go down into the pores or holes in the MCP so it does not effect the performance of the MCP. The back of the MCP is at ground with the phosphor screen being at a positive voltage. The back of the MCP is therefore the source of $E^-$ for a breakdown. With the MCP covered with the dielectric ($Al_2O_3$), tests conducted were unable to get the phosphor screen to breakdown even at 9000 volts.

By way of example, without the dielectric coating on the MCP, a 0.020 inch gap between the phosphor screen and the MCP, it was necessary to run to voltage at 3 kV, but with the 3 micron $Al_2O_3$ coating of this invention it could be run at 9 kV volts with the same 0.020 inch gap, a significant increase in voltage.

The advantages provided by the present invention are accomplished by increasing the dielectric strength between a photocathode microchannel plate and a phosphor screen. The microchannel plate is filled for example with 12 micron holes that emit the electrons that form the image on the phosphor screen. If the plate is brought closer to the screen the image is improved. This may be done without breakdown if the plate is provided or coated with a thin dielectric layer, such as alumina ($Al_2O_3$) without covering the holes in the plate. To accomplish this, for example, about 3 microns of $Al_2O_3$ is sputtered onto the back of the plate at a steep angle, about 75 degrees from normal. By application of the coating or layer to the back of the plate, the voltage has been increased over three times the prior voltage without breakdown. Thus, the spatial resolution is greatly improved.

Figure 1:
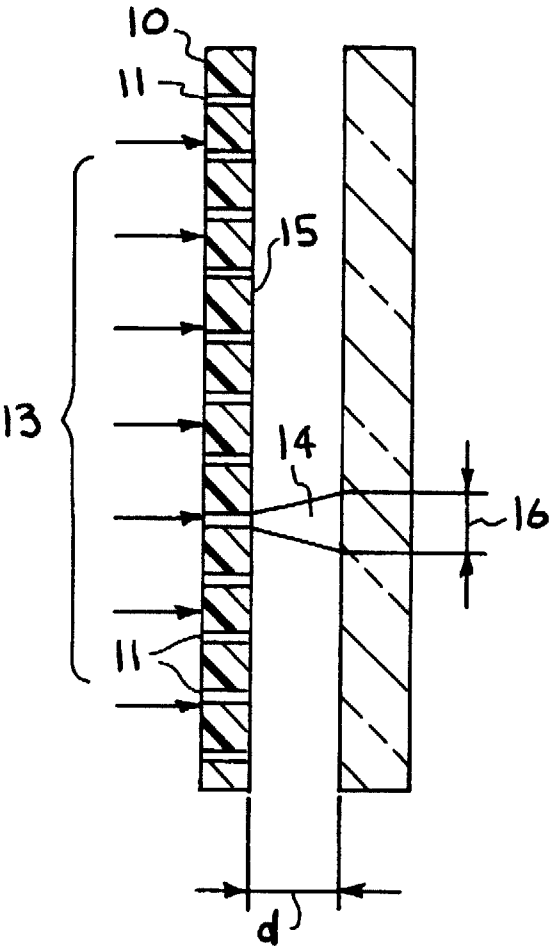
FIG. 1 (PRIOR ART)
FIG. 1 is a cross-sectional view of a prior art image intensifying device which includes a conventional microchannel plate (MCP) and a spaced phosphor screen.

FIG. 1 illustrates a prior art image intensifier device which includes a conventional microchannel plate (MCP) 10 having a plurality of holes 11 extending therethrough and positioned in spaced relation to a conventional phosphor screen 12, to form a gap, such as 0.040–0.045 inch, as indicated by distance "d". As known in the art, energy from a source 13 is directed onto MCP 10 as indicated by arrows, and electrons, indicated at 14, are emitted from the ground plane 15 of the MCP 10 and form an image or spot size 16 on the phosphor screen 12. The applied voltage and the distance "d" determine the spot size 16 on screen 12, and the larger the spot size the poorer the image resolution.

Figure 2:
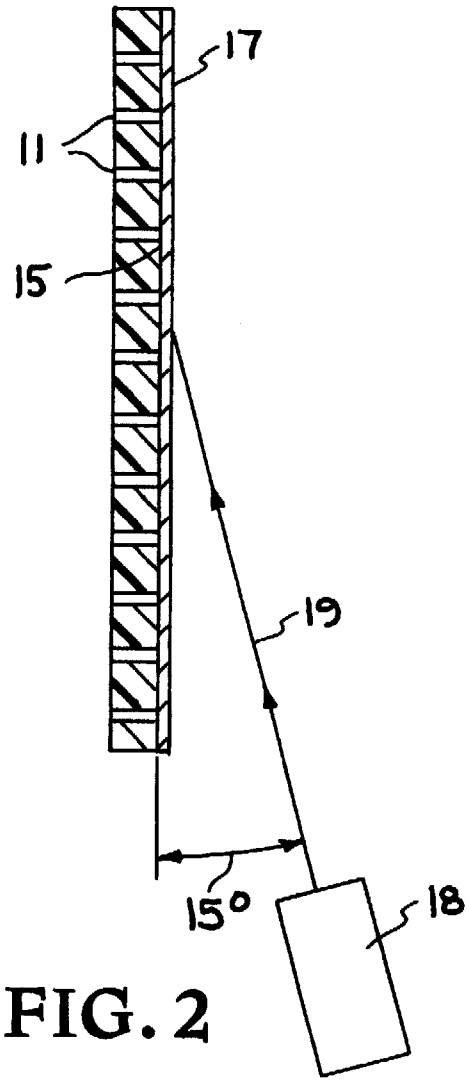
FIG. 2 schematically illustrates coating the MCP in accordance with the invention.

FIG. 2 illustrates coating of the ground plane or back 15 of MCP 10 of FIG. 1 with a layer 17 of insulator or dielectric materials, such as aluminum oxide ($Al_2O_3$) having a thickness of 3 microns, for example. The coating is accomplished such as by a sputtering technique having a source 18 which deposits the material from source 18 onto the MCP 10 as indicated by arrow 19 to form layer 17. To prevent the holes 11 in MCP 10 from being filled, the material forming layer 17 is sputtered at a 75° angle from normal (15° angle with respect to the ground plane 15), such that layer 17 includes openings 20 aligned with the holes 11 of the MCP as seen in FIG. 3. This angle may vary from 15°–20°.

FIG. 3 illustrates an embodiment of the invention wherein the back or ground plane 15 of a photocathode microchannel plate (MCP) 10 is coated with a thin layer or coating 17 of dielectric or insulator material without covering the holes 11 in the MCP; and which is positioned in close proximity with a phosphor screen 12 so as to form a gap between, as indicated by distance d', such as 0.020 inch. The preferred insulator or dielectric material is aluminum oxide ($Al_2O_3$) with a thickness of 3 microns, but other insulating or dielectric material such as silicon dioxide, titanium oxide and tantalum oxide may be utilized, and the coating thickness may range from 3 to 6 microns, depending on the specific application. As seen in FIG. 3, the spot size 16' produced by electrons 14 emitted from MCP 10 is substantially smaller than the spot size 16 in FIG. 1.

The thin layer or coating 17 of $Al_2O_3$ is deposited by sputtering onto the back or ground plane 15 of the MCP 10 at an angle of about 75° from the normal (15° with respect to the surface of ground plane 15) using an unbalanced magnetron sputtering technique and the following process parameters:

1. Continuous substrate (MCP ground plane) rotation during deposition, at a rotation rate of 5 revolutions per minute (RPM).
2. Source to substrate distance of 12 inches.
3. Seventy-five degree from normal angle of incidence from source to MCP. One channel diagram penetration in the out-put channel.
4. Vacuum system base pressure of 10–6 torr.
5. 99.999% Pure Argon.
6. High Purity Oxygen.
7. 200 Watts source power.
8. Unbalanced amperage of 2.0
9. Deposition rate of 6.5 angstroms per min.
10. Total thickness of Aluminum Oxide=3 microns.

As pointed out above, using the 3 microns thick coated MCP of FIG. 3 and with the gap or distance d', being 0.020 inch, the image intensifier device could be run at 9000 volts without breakdown, while without the coating 17, breakdown would occur at 3000 volts. Thus, by coating the ground plane of an MCP so as not to obstruct the holes in MCP, the phosphor screen can be located closer to the MCP and the voltage can be significantly increased, thus greatly improving spatial resolution.

While the coating or layer 17 of dielectric material has been described above as being deposited on the ground plane 15 by a sputtering technique, it can be produced by other deposition techniques, provided the holes 11 of microchannel plate 10 are not blocked by the coating. Also, the layer or coating 17 can be formed separately with openings 20 designed to match holes 11 of plate 10, and then positioned adjacent to or secured directly to the ground plane 15 of plate 10. However, any gaps between the ground plane and the coating will result in loss of efficiency due to electrons from plate 10 not passing through openings 20 in the coating and onto phosphor screen 12.

It has thus been shown that the present invention provides a significant improvement in spatial resolution of conventional image intensifying devices bv enabling the use of significantly high voltages and reduced gap or spacing between an MCP and an associated phosphor screen.

While a particular embodiment of the invention has been illustrated and described, and a particular coating technique has been exemplified, as well as exemplary materials, parameters, etc., having been set forth, such is not intended to limit the invention to those particulars described or illustrated. Modifications and changes of the invention, as well as modified or different coating techniques, will become apparent to those skilled in the art, and the scope of the invention is to be limited only by the scope of the appended claims.

I claim:

1. In a microchannel plate, the improvement comprising:

a layer of dielectric material on the ground plane of the microchannel plate;

said layer of dielectric material being provided with openings which align with without covering holes in the microchannel plate.

2. The improvement of claim 1, wherein said layer of dielectric material has a thickness of 3 to 6 microns.

3. The improvement of claim 1, wherein said layer of dielectric material is fabricated from the group consisting of aluminum oxide, silicon dioxide, titanium oxide and tantalum oxide.

4. The improvement of claim 3, wherein said layer of dielectric material is composed of aluminum oxide and has a thickness of about 3 microns.

5. In an image intensifier including a microchannel plate and a phosphor screen positioned in spaced relation with said plate, the improvement comprising:

a layer of electrically insulating material positioned adjacent a ground plane of said microchannel plate and having openings therein which align with but do not cover holes in said microchannel plate.

6. The improvement of claim 5, wherein said layer of electrically insulating material is constructed from material selected from the group consisting of aluminum oxide, silicon dioxide, titanium oxide and tantalum oxide.

7. The improvement of claim 6, wherein said layer of electrically insulating material has a thickness in the range of 3 to 6 microns.

8. The improvement of claim 6, wherein said layer of electrically insulating material is secured to said ground plane of said microchannel plate.

9. The improvement of claim 6, wherein said layer of electrically insulating material is deposited directly on said ground plane of said microchannel plate.

10. The improvement of claim 5, wherein said phosphor screen is spaced at a distance of about 0.020 inch from said microchannel plate, and a potential of at least 9000 volts is applied there between.

11. The improvement of claim 6, wherein said layer of electrically insulating material is composed of aluminum oxide deposited on said ground plane of said microchannel plate to a thickness of about 3 microns by a sputtering technique.

12. A method for improving the spatial resolution of proximity focused image intensifiers which includes a microchannel plate and a phosphor screen spaced therefrom to form a gap therebetween, including the steps of:

positioning a layer of dielectric material intermediate the microchannel plate and the phosphor screen and adjacent to the microchannel plate; and forming openings in the layer of dielectric material which align with but do not cover holes in the microchannel plate.

13. The method of claim 12, additionally including the step of securing the layer of dielectric material to the ground plane of the microchannel plate.

14. The method of claim 12, additionally including the step of forming the layer of dielectric material by depositing the layer directly on the ground plane of the microchannel plate.

15. The method of claim 14, wherein the step of forming the layer of dielectric material is carried by deposition via a sputtering technique.

16. The method of claim 15, wherein the sputtering technique includes directing dielectric material onto the ground plane from a source located at an angle of about 15 to 20 degrees with respect to the surface of the ground plane, for preventing holes in the microchannel plate from being covered by the dielectric material.

17. The method of claim 16, additionally including the step of rotating the ground plane during the sputtering of dielectric material onto the ground plane.

18. The method of claim 14, wherein the step of forming the layer of dielectric material is carried out so as to produce a layer thickness of about 3 microns.

19. The method of claim 14, wherein the step of forming the layer of dielectric material is carried out by depositing aluminum oxide directly onto the ground plane.

20. The method of claim 12, additionally including the steps of positioning the microchannel plate and the phosphor screen so as to provide a gap of about 0.020 inch between the screen and the microchannel plate, and applying a voltage therebetween of up to at least 9000 volts.

* * * * *